US010326243B2

(12) United States Patent
Huang

(10) Patent No.: US 10,326,243 B2
(45) Date of Patent: Jun. 18, 2019

(54) CONNECTOR AND CONNECTOR ASSEMBLY

(71) Applicant: Tyco Electronics (Shanghai) Co. Ltd., Shanghai (CN)

(72) Inventor: Liang Huang, Shanghai (CN)

(73) Assignee: Tyco Electronics (Shanghai) Co. Ltd., Shanghai (CN)

( * ) Notice: Subject to any disclaimer, the term of this patent is extended or adjusted under 35 U.S.C. 154(b) by 0 days.

(21) Appl. No.: 15/809,268

(22) Filed: Nov. 10, 2017

(65) Prior Publication Data

US 2018/0138637 A1 May 17, 2018

(30) Foreign Application Priority Data

Nov. 11, 2016 (CN) ..... 2016 1 1040160

(51) Int. Cl.

| | |
|---|---|
| ***H01R 12/57*** | (2011.01) |
| ***H01R 12/71*** | (2011.01) |
| ***H01R 12/73*** | (2011.01) |
| ***H01R 13/24*** | (2006.01) |
| ***H01R 13/405*** | (2006.01) |
| ***H01R 13/6471*** | (2011.01) |

(52) U.S. Cl.
CPC ..... *H01R 13/6471* (2013.01); *H01R 12/716* (2013.01); *H01R 13/24* (2013.01); *H01R 13/405* (2013.01); *H01R 12/57* (2013.01); *H01R 12/73* (2013.01)

(58) Field of Classification Search
CPC .... H01R 23/7068; H01R 13/26; H01R 23/02; H01R 13/6471; H01R 13/405; H01R 13/24; H01R 12/716; H01R 12/57; H01R 12/73
USPC ..... 439/660, 924.1, 951
See application file for complete search history.

(56) References Cited

U.S. PATENT DOCUMENTS

| | | | | |
|---|---|---|---|---|
| 6,142,802 A * | 11/2000 | Berg | H01R 12/57 385/75 |
| 7,440,287 B1 * | 10/2008 | Ni | H01R 27/00 174/50.51 |
| 8,292,671 B2 * | 10/2012 | Chung | H01R 12/52 439/660 |
| 8,591,265 B2 * | 11/2013 | Huang | H01R 24/60 439/660 |
| 8,662,917 B2 * | 3/2014 | Wang | H01R 9/038 439/493 |
| 8,882,540 B2 * | 11/2014 | Yen | H01R 27/00 439/489 |

(Continued)

*Primary Examiner* — Gary F Paumen
(74) *Attorney, Agent, or Firm* — Barley Snyder

(57) ABSTRACT

A connector comprises a housing, a plurality of rows of terminals disposed in the housing, and an insertion tongue disposed in the housing. The plurality of rows of terminals include at least a row of first terminals and a row of second terminals adjacent to the row of first terminals. The insertion tongue has a first side and a second side opposite to the first side. Each of first terminals has a first contact portion held on the first side of the insertion tongue and each of second terminals has a second contact portion held on the second side of the insertion tongue. A first end part of the first contact portions of at least some of the first terminals are disconnected from the first terminals. A second end part of the second contact portions of at least some of the second terminals are disconnected from the second terminals.

16 Claims, 7 Drawing Sheets

(56) References Cited

U.S. PATENT DOCUMENTS

| | | | | |
|---|---|---|---|---|
| 2004/0212386 | A1* | 10/2004 | Lin | G01R 1/0735 324/760.01 |
| 2006/0065437 | A1* | 3/2006 | Yumoto | G02F 1/13452 174/260 |
| 2013/0083505 | A1* | 4/2013 | Kobayashi | H05K 1/11 361/785 |
| 2014/0154927 | A1* | 6/2014 | Nonen | H01R 9/037 439/660 |
| 2014/0235108 | A1* | 8/2014 | Shiratori | H01R 13/652 439/660 |
| 2014/0273652 | A1* | 9/2014 | Szu | H01R 24/00 439/660 |
| 2016/0020568 | A1* | 1/2016 | Ju | H01R 24/78 439/607.01 |

* cited by examiner

CONNECTOR AND CONNECTOR ASSEMBLY

CROSS-REFERENCE TO RELATED APPLICATION

This application claims the benefit of the filing date under 35 U.S.C. § 119(a)-(d) of Chinese Patent Application No. 201611040160.4, filed on Nov. 11, 2016.

FIELD OF THE INVENTION

The present disclosure relates to a connector and, more particularly, to a connector having a terminal elastically contacting a mating terminal of a mating connector.

BACKGROUND

In two mating connectors in the prior art, a first connector has a plug while a second connector has an insertion chamber. The plug is adapted to be inserted into the insertion chamber. A conductive terminal of the first connector is fixedly attached to the plug. A resilient arm of a conductive terminal of the second connector extends into the insertion chamber and comes into elastic electrical contact with the conductive terminal of the first connector.

During mating of the first connector and the second connector, an electrical contact of the resilient arm is brought into elastic electrical contact with the conductive terminal of the first connector. The electrical contact slides on a surface of the conductive terminal of the first connector a predetermined distance, or scratch distance, to automatically scrape off an oxide layer formed on the surface of the conductive terminals of the first and second connectors, ensuring better electrical contact performance.

In order to ensure a sufficient scratch distance between the conductive terminal of the first connector and the conductive terminal of the second connector during mating, the conductive terminal of the first connector needs to have a sufficient length. However, in an instance in which the first connector has two adjacent rows of conductive terminals, the excessive length of the conductive terminals results in an increased coupling between the two adjacent rows of conductive terminals of the first connector, initiating resonance between the two adjacent rows of conductive terminals of the first connector. The longer the length of the two adjacent rows of conductive terminals, the greater the coupling between the two adjacent rows of conductive terminals, and the stronger the resonance between the two adjacent rows of conductive terminals. Resonance affects the function of the first connector and the second connector in use, limiting a working bandwidth.

SUMMARY

A connector comprises a housing, a plurality of rows of terminals disposed in the housing, and an insertion tongue disposed in the housing. The plurality of rows of terminals include at least a row of first terminals and a row of second terminals adjacent to the row of first terminals. The insertion tongue has a first side and a second side opposite to the first side. Each of first terminals has a first contact portion held on the first side of the insertion tongue and each of second terminals has a second contact portion held on the second side of the insertion tongue. A first end part of the first contact portions of at least some of the first terminals are disconnected from the first terminals. A second end part of the second contact portions of at least some of the second terminals are disconnected from the second terminals.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
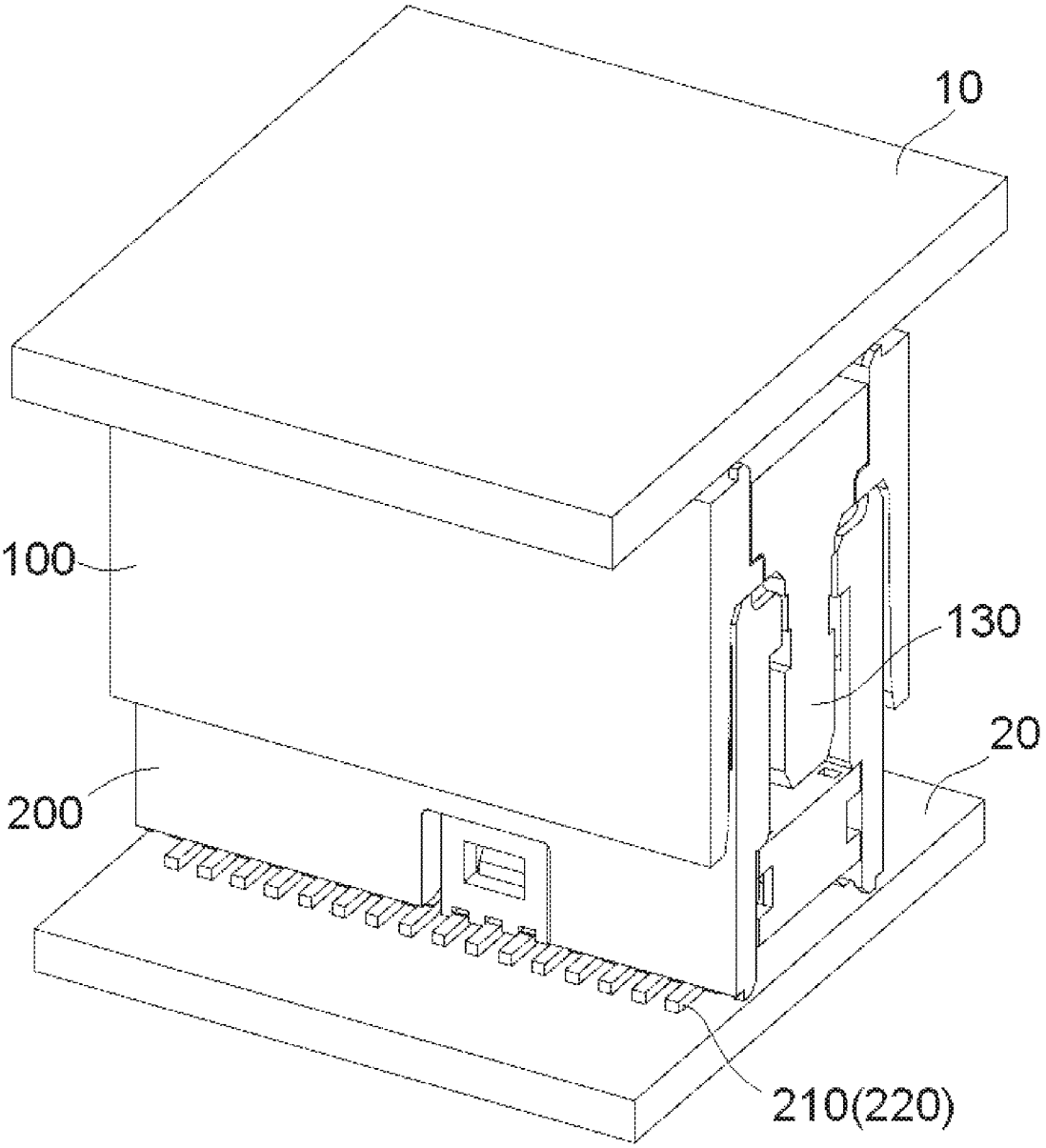
FIG. 1 is a perspective view of a connector according to an embodiment of the invention and a mating connector.

Embodiments of the present invention will be described hereinafter in detail with reference to the attached drawings, wherein like reference numerals refer to the like elements. The present invention may, however, be embodied in many different forms and should not be construed as being limited to the embodiments set forth herein; rather, these embodiments are provided so that the disclosure will be thorough and complete and will fully convey the concept of the invention to those skilled in the art.

Figure 2:
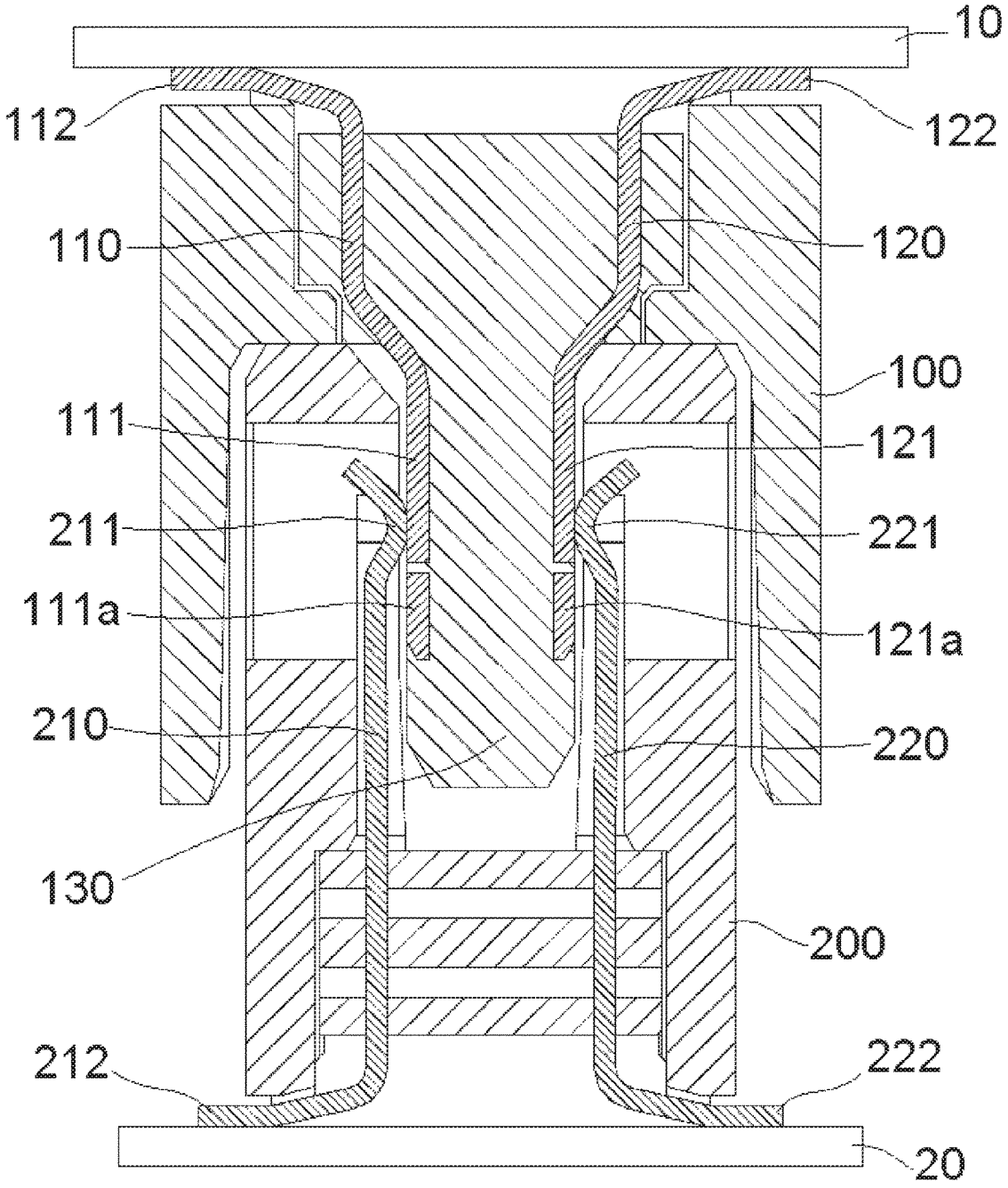
FIG. 2 is a sectional view of the connector and the mating connector of FIG. 1.

A connector according to an embodiment of the invention is shown in FIGS. 1 and 2. The connector is matable with a mating connector. The connector comprises a housing 100; a plurality of rows of terminals 110, 120, and an insertion tongue 130. The plurality of rows of terminals 110, 120 are disposed in the housing 100 and include at least a row of first terminals 110 and a row of second terminals 120 adjacent to the row of first terminals 110. The insertion tongue 130 is disposed in the housing 100 and has a first side and a second side opposite to the first side.

Figure 3:
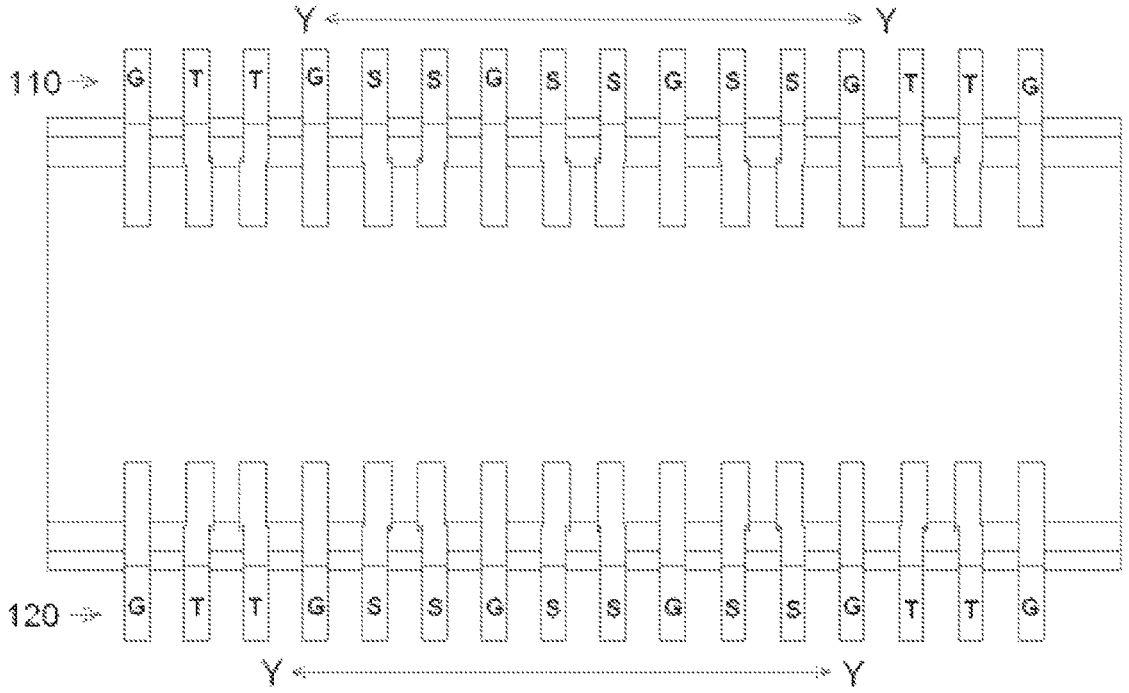
FIG. 3 is a plan view of a plurality of adjacent rows of terminals of the connector of FIG. 2.

First contact portions 111 of the row of first terminals 110 and second contact portions 121 of the row of second terminals 120, as shown in FIG. 2, are held on the first side and the second side of the insertion tongue 130, respectively. First end parts 111*a* of the first contact portions 111 of at least some of the first terminals 110 are physically disconnected from the first terminals 110. Second end parts 121*a* of the second contact portions 121 of at least some of the second terminals 120, corresponding to or facing the at least some of the first terminals 110 as shown in FIG. 3, are physically disconnected from the respective second terminals 120. Each of the contact portions 111, 121 of the at least some of the first terminals 110 and the at least some of the second terminals 120 thereby has two parts which are electrically isolated from each other.

As shown in FIG. 3, the terminals of the row of first terminals 110 correspond to or face the terminals of the row of second terminals 120. The row of first terminals 110 and the row of second terminals 120 each has at least one pair of high speed differential signal terminals S, S. In the shown embodiment, the row of first terminals 110 and the row of second terminals 120 each has three pairs of high speed differential signal terminals S, S. In other embodiments, the row of first terminals 110 and the row of second terminals 120 may each have one pair, two pairs, or four or more pairs of high speed differential signal terminals S, S. The row of first terminals 110 and the row of second terminals 120 each further has at least one pair of low speed differential signal terminals T, T. In the shown embodiment, the row of first terminals 110 and the row of second terminals 120 each has two pairs of low speed differential signal terminals T, T. In other embodiments, the row of first terminals 110 and the row of second terminals 120 may each have one pair or three or more pairs of low speed differential signal terminals T, T. The row of first terminals 110 and the row of second terminals 120 each further comprise at least one ground terminal G. The ground terminal G is located between two pair of high speed differential signal terminals S or between a pair of low speed differential signal terminals T and a pair of high speed differential signal terminals S. In the shown embodiment, the row of first terminals 110 and the row of second terminals 120 each have six ground terminals G.

Figure 4:
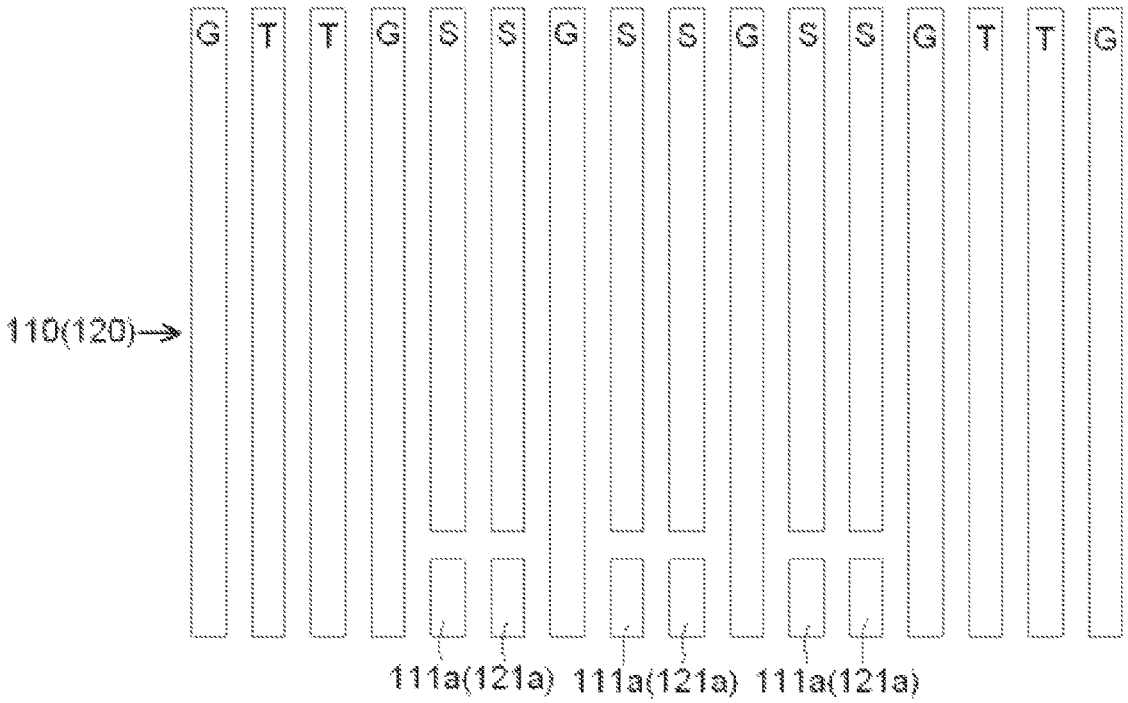
FIG. 4 is a schematic view of a row of terminals of the connector of FIG. 2 according to an embodiment of the invention.

In an embodiment shown in FIG. 4, the end parts 111*a*, 121*a* of the first contact portions 111, 121 of the high speed differential signal terminals S in the row of first terminals 110 and the row of second terminals 120 are physically disconnected from the respective high speed differential signal terminals S; the end parts 111*a*, 121*a* of the first contact portions 111, 121 of other terminals G, T other than the high speed differential signal terminals S in the row of first terminals 110 and the row of second terminals 120 are not physically disconnected from the respective terminals G, T. The high speed differential signal terminals S in the row of first terminals 110 and the row of second terminals 120 thereby each have two parts which are electrically isolated from each other; the other terminals G, T in the row of first terminals 110 and the row of second terminals 120 are each formed as a single piece.

Figure 5:
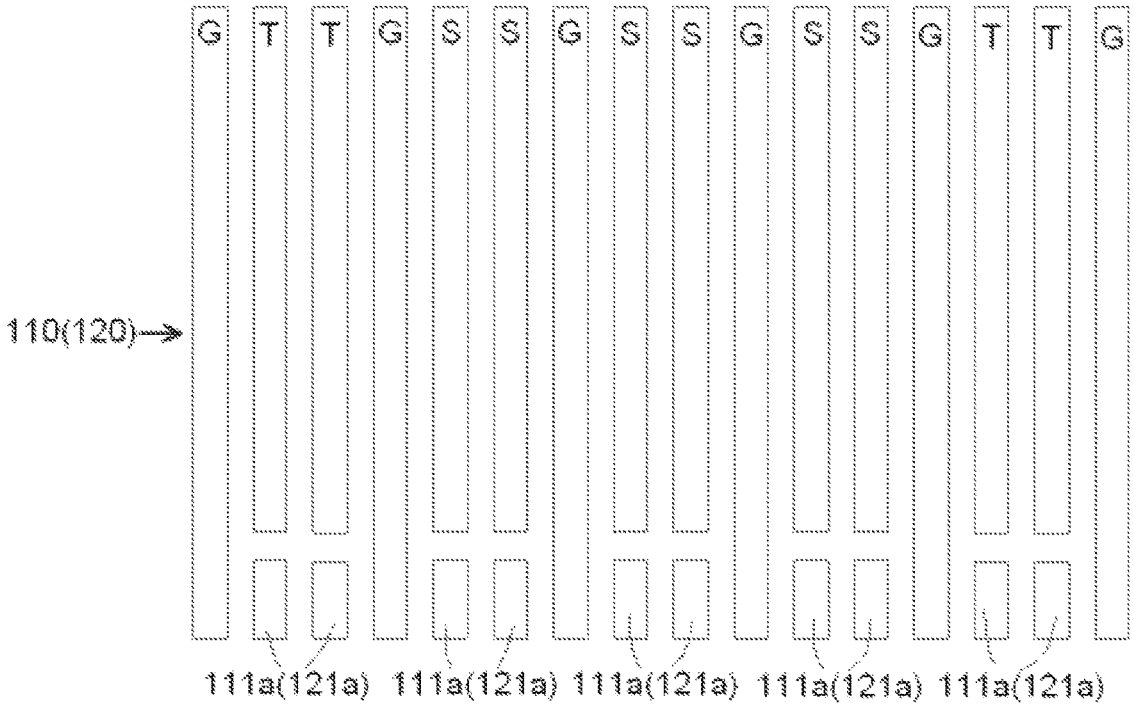
FIG. 5 is a schematic view of a row of terminals of the connector of FIG. 2 according to another embodiment of the invention.

In an embodiment shown in FIG. 5, the end parts 111*a*, 121*a* of the first contact portions 111, 121 of the high speed differential signal terminals S and the low speed differential signal terminals T in the row of first terminals 110 and the row of second terminals 120 are both physically disconnected from the respective terminals; the end parts 111*a*, 121*a* of the first contact portions 111, 121 of ground terminals G other than the high speed differential signal terminals S and the low speed differential signal terminals T in the row of first terminals 110 and the row of second terminals 120 are not physically disconnected from the respective ground terminals G. The end parts 111*a*, 121*a* of the first contact portions 111, 121 of ground terminals G extend integrally from the respective ground terminals G.

Figure 6:
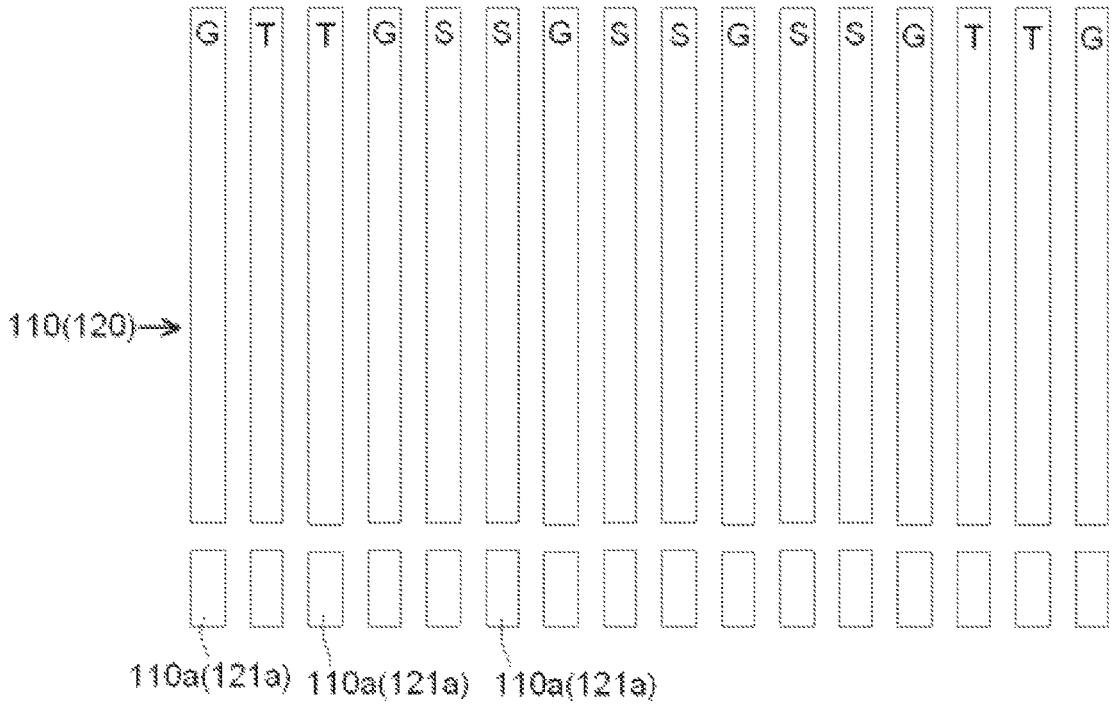
FIG. 6 is a schematic view of a row of terminals of the connector of FIG. 2 according to another embodiment of the invention.

In an embodiment shown in FIG. 6, the end parts 111*a*, 121*a* of the first contact portions 111, 121 of the high speed differential signal terminals S, the low speed differential signal terminals T and the ground terminals G in the row of first terminals 110 and the row of second terminals 120 are all disconnected from the respective terminals. Each first contact portion 111, 121 comprises two parts which are electrically isolated from each other.

Figure 7:
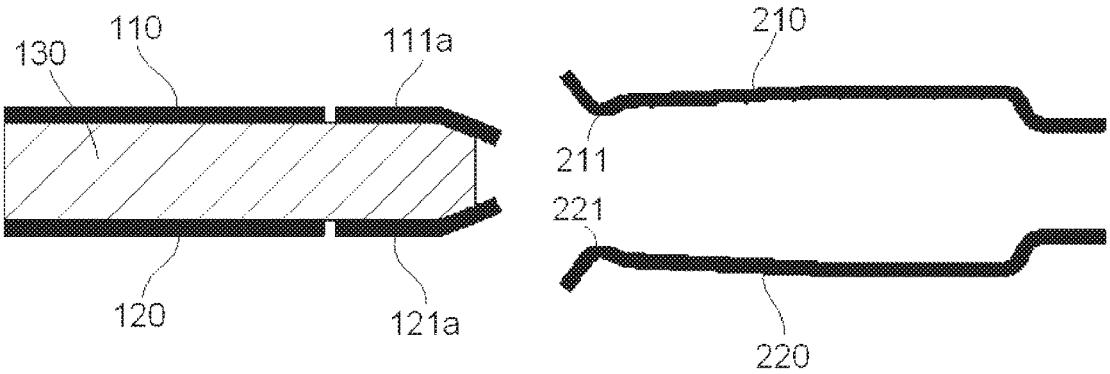
FIG. 7 is a sectional view of the terminals of the connector and the terminals of the mating connector of FIG. 2 before coming into contact with each other.

A connector assembly according to the invention comprises the connector and the mating connector. The mating connector, as shown in FIGS. 1, 2, and 7, comprises a housing 200 and two rows of terminals 210, 220 disposed in the housing 200 and adapted to come into electrical contact with the row of first terminals 110 and the row of second terminals 120 of the connector 100, respectively. Each terminal 210, 220 of the two rows of terminals 210, 220 of the mating connector has an electrical contact 211, 221 adapted to come into elastic electrical contact with the contacting portion 111, 121 of the terminal 110, 120 of the connector.

As shown in FIG. 2, each terminal of the row of first terminals 110 and the row of second terminals 120 has a soldering pad 112, 122 adapted to be soldered to a first circuit board 10. Each terminal 210, 220 of the two rows of terminals 210, 220 of the mating connector has a soldering pad 212, 222 adapted to be soldered to a second circuit board 20. The first circuit board 10 and the second circuit board 20 are electrically connected to each other via the connector and the mating connector.

Figure 8:
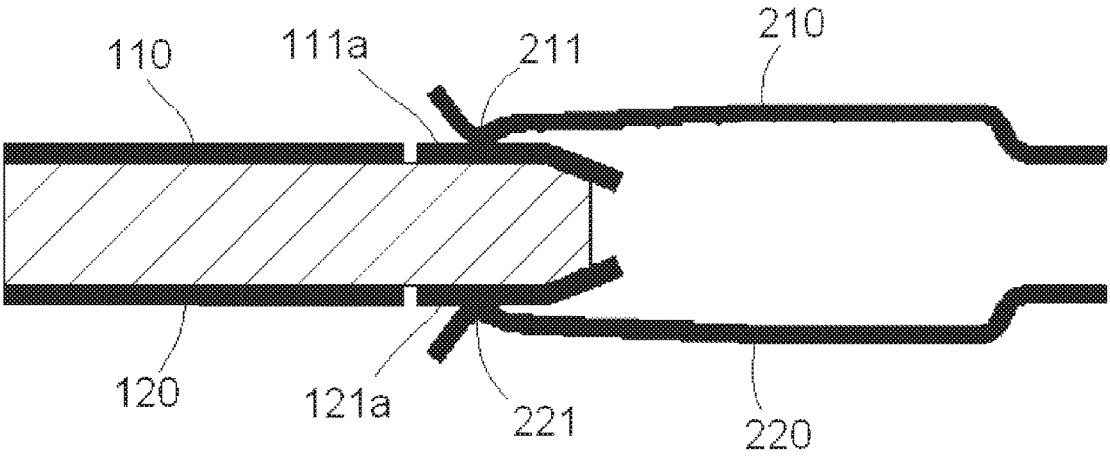
FIG. 8 is a sectional view of the terminals of the mating connector contacting a plurality of disconnected end parts of the terminals of the connector.
Figure 9:
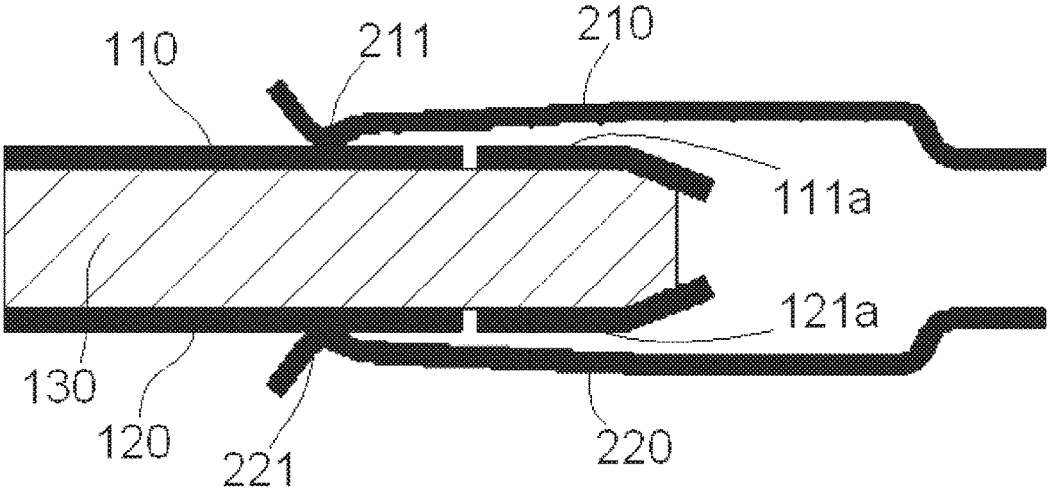
FIG. 9 is a sectional view of the terminals of the mating connector contacting terminals of the connector.

A process of inserting the insertion tongue 130 of the connector between the two rows of terminals 210, 220 of the mating connector is shown in FIGS. 7-9. FIG. 7 shows a schematic view of the terminals 110, 120 of the connector and terminals 210, 220 of the mating connector before coming into contact with each other. As shown in FIG. 8, at the beginning of the insertion, the electrical contacts 211, 221 of the terminals 210, 220 of the mating connector 200 come into contact with the disconnected end parts 111*a*, 121*a* of the terminals 110, 120 of the connector 100, and at this time, the terminals 210, 220 of the mating connector 200 are not electrically connected to the terminals 110, 120 of the connector 100. As shown in FIG. 9, when completing the insertion, the electrical contacts 211, 221 of the terminals 210, 220 of the mating connector 200 come into contact with the electrical first contact portions 111, 121 of the terminals 110, 120 of the connector 100, and at this time, the terminals 210, 220 of the mating connector 200 are electrically connected to the terminals 110, 120 of the connector 100.

Since end parts 111*a*, 121*a* of the contact portions 111, 121 of at least some of the two adjacent rows of terminals 110, 120 are disconnected from the respective terminals 110, 120, the effective conductive length of the respective terminals 110, 120 is reduced, effectively suppressing the resonance between the two adjacent rows of terminals 110, 120. In addition, the end parts 111*a*, 121*a* disconnected from the respective terminals 110, 120 of the connector 100 may still scratch mating terminals 210, 22*o* of the mating connector 200; a sufficient scratch distance is thereby still ensured between the connector 100 and the mating connector 200.

What is claimed is:

1. A connector, comprising:

a housing;

a plurality of rows of terminals disposed in the housing and including at least a row of first terminals and a row of second terminals adjacent to the row of first terminals, the terminals of the row of first terminals corresponding to the terminals of the row of second terminals; and an insertion tongue disposed in the housing and having a first side and a second side opposite to the first side, each of the terminals of the row of first terminals having a first contact portion held on the first side of the insertion tongue and each of the terminals of the row of second terminals having a second contact portion held on the second side of the insertion tongue, a first end part of the first contact portions of each of the first terminals are disconnected from the first terminals and a second end part of the second contact portions of each of the second terminals are disconnected from the second terminals.

2. The connector of claim 1, wherein the row of first terminals and the row of second terminals each have at least one pair of high speed differential signal terminals.

3. The connector of claim 2, wherein the row of first terminals and the row of second terminals each have at least one pair of low speed differential signal terminals.

4. The connector of claim 3, wherein the row of first terminals and the row of second terminals each have at least one ground terminal.

5. The connector of claim 4, wherein the ground terminal is disposed between two pair of high speed differential signal terminals.

6. The connector of claim 4, wherein the ground terminal is disposed between a pair of low speed differential signal terminals and a pair of high speed differential signal terminals.

7. A connector assembly, comprising;

a connector including:

(a) a housing;

(b) a plurality of rows of terminals disposed in the housing and including at least a row of first terminals and a row of second terminals adjacent to the row of first terminals, the terminals of the row of first terminals corresponding to the terminals of the row of second terminals; and (c) an insertion tongue disposed in the housing and having a first side and a second side opposite to the first side, each of the terminals of the row of first terminals having a first contact portion held on the first side of the insertion tongue and each of the terminals of the row of second terminals having a second contact portion held on the second side of the insertion tongue, a first end part of the first contact portions of each of the first terminals are disconnected from the first terminals and a second end part of the second contact portions of each of the second terminals are disconnected from the second terminals; and a mating connector adapted to be mated with the connector.

8. The connector assembly of claim 7, wherein the mating connector includes a mating housing and a pair of rows of mating terminals disposed in the mating housing.

9. The connector assembly of claim 8, wherein the pair of rows of mating terminals are adapted to electrically contact the row of first terminals and the row of second terminals.

10. The connector assembly of claim 9, wherein each mating terminal of the pair of rows of mating terminals has an electrical contact coming into elastic electrical contact with one of the first and second contact portions of the row of first terminals and the row of second terminals.

11. The connector assembly of claim 10, wherein each terminal of the row of first terminals and the row of second terminals has a first soldering pad soldered to a first circuit board.

12. The connector assembly of claim 11, wherein each mating terminal of the pair of rows of mating terminals has a second soldering pad soldered to a second circuit board.

13. The connector assembly of claim 10, wherein the electrical contact of each mating terminal of the pair of rows of mating terminals contacts the first end part of the first contact portion or the second end part of the second contact portion before coming into elastic electrical contact with the one of the first and second contact portions.

14. The connector of claim 1, wherein the first end parts of each of the first contact portions are disconnected from the first terminals at a same position along a longitudinal direction of the first terminals and the second end parts of each of the second contact portions are disconnected from the second terminals at a same position along a longitudinal direction of the second terminals.

15. The connector assembly of claim 7, wherein the first end parts of each of the first contact portions are disconnected from the first terminals at a same position along a longitudinal direction of the first terminals and the second end parts of each of the second contact portions are disconnected from the second terminals at a same position along a longitudinal direction of the second terminals.

16. The connector assembly of claim 13, wherein the pair of rows of mating terminals do not electrically contact the row of first terminals and the row of second terminals when the electrical contact of each mating terminal elastically contacts the first end parts of the first contact portions and the second end parts of the second contact portions.

* * * * *